US008927839B2

(12) United States Patent
Hammack

(10) Patent No.: US 8,927,839 B2
(45) Date of Patent: Jan. 6, 2015

(54) STRINGED INSTRUMENT HAND REST

(71) Applicant: Carl D. Hammack, Lebanon Junction, KY (US)

(72) Inventor: Carl D. Hammack, Lebanon Junction, KY (US)

( * ) Notice: Subject to any disclaimer, the term of this patent is extended or adjusted under 35 U.S.C. 154(b) by 4 days.

(21) Appl. No.: 13/772,502

(22) Filed: Feb. 21, 2013

(65) Prior Publication Data

US 2013/0213207 A1 Aug. 22, 2013

Related U.S. Application Data

(60) Provisional application No. 61/601,283, filed on Feb. 21, 2012.

(51) Int. Cl.
*G10D 3/18* (2006.01)

(52) U.S. Cl.
CPC ..... *G10D 3/18* (2013.01)
USPC ..... 84/328

(58) Field of Classification Search
USPC ..... 84/290, 327, 328
See application file for complete search history.

(56) References Cited

U.S. PATENT DOCUMENTS 5,994,633 A * 11/1999 Norton ..... 84/290

FOREIGN PATENT DOCUMENTS

DE 10053401 A1 * 4/2001 ..... 84/328

* cited by examiner

*Primary Examiner* — Kimberly Lockett
(74) *Attorney, Agent, or Firm* — Wood, Herron & Evans, LLP

(57) ABSTRACT

A hand rest for a guitar or other such stringed instrument configured to be positioned over strings of the stringed instrument such that a user of the stringed instrument may rest a hand on at least a portion of the hand rest while using the stringed instrument. Furthermore, the hand rest is configured to not interfere with a user striking one or more strings and the vibration of one or more strings.

16 Claims, 6 Drawing Sheets

STRINGED INSTRUMENT HAND REST

CROSS REFERENCE TO RELATED APPLICATIONS

This application claims priority to U.S. Provisional Application Ser. No. 61/601,283 filed by Carl D. Hammack on Feb. 21, 2012, and entitled "STRINGED INSTRUMENT HAND REST," which application is incorporated by reference in its entirety.

FIELD OF THE INVENTION

The invention is generally related to an accessory for stringed instruments.

BACKGROUND OF THE INVENTION

Many stringed instruments generally require a user to strike (e.g., "pluck, pick, etc.) one or more strings to vibrate the strings, which causes sound to be produced. For example, a user may pick a particular string on a guitar to cause a particular note to be played. Other stringed instruments, such as a banjo, bass guitar, mandolin, etc. are played using generally the same principles. A variety of methods are typically employed to strike desired strings, for example, some guitar players prefer to pluck strings with their fingers (i.e., "finger-picking"), while other guitar players prefer using a pick to pluck strings.

Finger-picking an instrument generally requires a user to maintain a hand position over the strings of the instrument while using different fingers to strike different strings. When finger-picking for prolonged periods, the required position can become tiring to maintain for the user. In these situations, the user may position the finger-picking hand incorrectly, which may lead to striking incorrect notes, hand and finger cramps, or muffling the vibration of the strings.

Therefore, a need continues to exist in the art for improving the comfort of a user while playing a stringed instrument while maintaining the proper position.

SUMMARY OF THE INVENTION

The invention addresses these and other problems associated with the prior art by providing a hand rest capable of being coupled to a body of a stringed instrument and positioned over the strings of the instrument such that the hand rest and the user's hand does not interfere with the vibration of the strings but allows a user to maintain proper positioning for striking/actuating the strings. Embodiments consistent with the invention may be removably coupleable to a stringed instrument. Furthermore, a hand rest consistent with some embodiments of the invention may be rotatable with respect to the stringed instrument such that a supporting portion of the hand rest may be positioned over the strings in a first position and may be rotated to a second position not positioned over the strings. Furthermore, embodiments of the invention may vary based on the type of stringed instrument for which a particular embodiment is designed to be used with.

Consistent with one aspect of the invention, for example, a hand rest for a stringed instrument may include a supporting portion positioned over strings of the stringed instrument to support a user's hand during use of the stringed instrument such that a portion of the user's hand may be suspended over the strings without inhibiting vibration of the strings, and a securing member coupling the supporting portion to the stringed instrument.

Consistent with another aspect of the invention, a hand rest for an electric guitar may include a mounting plate configured to removably couple to a portion of an electric guitar, and a supporting portion connected to the mounting plate and configured to be positioned over strings of the electric guitar when the mounting plate is removably coupled to the electric guitar to support a user's hand during use of the electric guitar such that a portion of the user's hand may be suspended over the strings without inhibiting vibration of the strings.

Consistent with still another aspect of the invention, a hand rest for an acoustic guitar may include a supporting portion comprising first and second opposing ends and positioned over the strings of the acoustic guitar to support a user's hand during use of the acoustic guitar such that a portion of the user's hand may be suspended over the strings without inhibiting vibration of the strings, and at least one securing member coupling the first and second opposing ends of the supporting portion to the acoustic guitar on opposite sides of the strings.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Embodiments consistent with the invention provide a hand rest for a user of a stringed instrument, where the hand rest may be positioned over the strings of the stringed instrument to accommodate an appropriate hand position while not interfering with vibrations of one or more of the strings. Typically, the hand rest includes a supporting portion that at least partially overlays the strings of the stringed instrument between the nut and bridge of the stringed instrument such that the user's hand may rest on the supporting portion and be disposed in a position that, absent the hand rest, would otherwise muffle or mute the strings if brought into contact with the strings. In particular, the supporting portion may be positioned over the strings to support a user's hand during use of the stringed instrument such that a portion of the user's hand (e.g., the palm) may be suspended over the strings without inhibiting vibration of the strings. Consequently, a user may play the stringed instrument with reduced fatigue and greater precision than would occur were the user required to suspend his or her hand in free space above the strings. Moreover, in some embodiments, the provision of a hand rest enables a user to more comfortably strike/actuate strings of a stringed instrument closer to the strings' midpoints, thereby providing a fuller tone.

Figure 1:
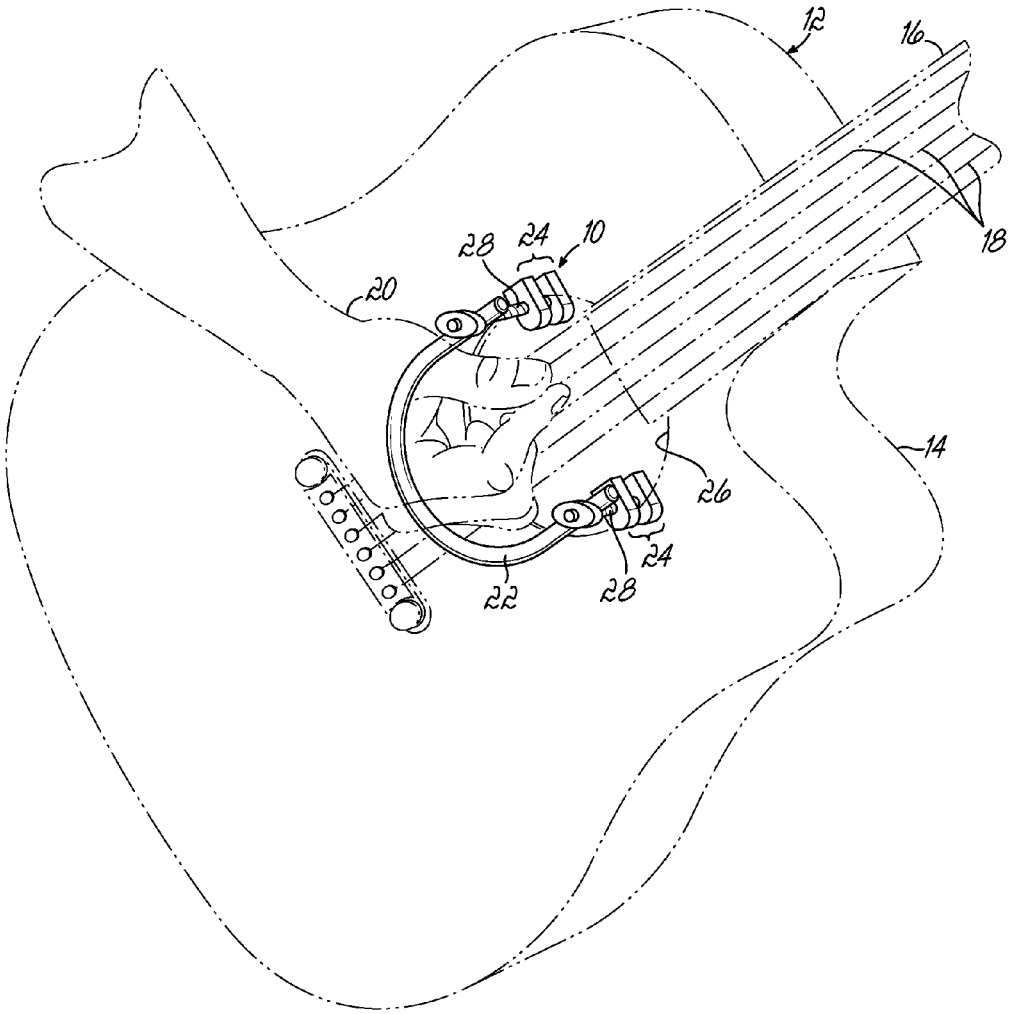
FIG. 1 is a diagram of a hand rest consistent with an embodiment of the invention and removably coupled to a stringed instrument.

FIG. 1 illustrates an exemplary embodiment of a hand rest 10 consistent with an embodiment of the invention coupled to a stringed instrument, which in this case is an acoustic guitar 12. As is generally known in the relevant field and relevant to the disclosure of the invention, the guitar 12 includes a body 14, a neck 16 and a plurality of strings 18 coupled to the body 14 and extending up the neck 16 as shown in FIG. 1. As shown, the hand rest 10 consistent may be coupled to the body 14 of the guitar 12 and positioned over the strings 18 at a location on the body 14 where the strings are to be struck by a user.

As shown, a user (i.e., the hand 20 provided in phantom) may rest a hand 20 on the hand rest 10 coupled to the guitar 12 and thereby position the hand 20 over the strings 18 to facilitate picking (i.e., striking/actuating) of the strings. Advantageously, using the hand rest 10, the user may maintain a playing position for the hand 20 while also resting the hand 20. As such, a user finger-picking the guitar 12 may rest the palm of his hand on the hand rest 10 while picking the strings 18. In addition, a user picking the guitar 12 using a guitar pick or other similar device may rest his hand on the hand rest 10 while picking the strings 18. Moreover, the hand rest is spaced apart from the strings 18 such that the hand rest 10 does not interfere with vibration of the strings 18.

As will be described in detail below, the hand rest 10 may comprise a supporting portion 22 that may be positioned over the strings 18 of a stringed instrument (in FIG. 1, the guitar 12), such that the user may rest a hand 20 on the supporting portion 22. In general, the supporting portion 22 may be removably coupleable to a stringed instrument by one or more securing members 24, which in the example of FIG. 1 are adjustable clamps configured to clamp to the body of the acoustic guitar 12 through a sound hole 26 of the acoustic guitar 12. In addition, the supporting portion 22 may be connected to a securing member 24 by a threaded member 28 that passes through a corresponding threaded opening in the supporting portion 22 and the securing member 24. As such, the distance between the supporting portion 22 and the strings 18 may be adjustable by rotation of the threaded member 28. In some embodiments, the supporting portion overlays the strings at a position between the bridge and the nut of the guitar, and in some embodiments, overlays the strings at a position over the sound hole of the guitar. In some embodiments, the securing members secure the opposing ends of the supporting portion to the guitar on opposite sides of the strings, as illustrated in FIG. 1.

As shown in FIG. 1, supporting portion 22 may be u-shaped, at least where the supporting portion overlays the strings. Other shapes may be used in the alternative, and in some embodiments, the supporting portion may simply extend linearly in a transverse relationship to the strings.

Figure 2:
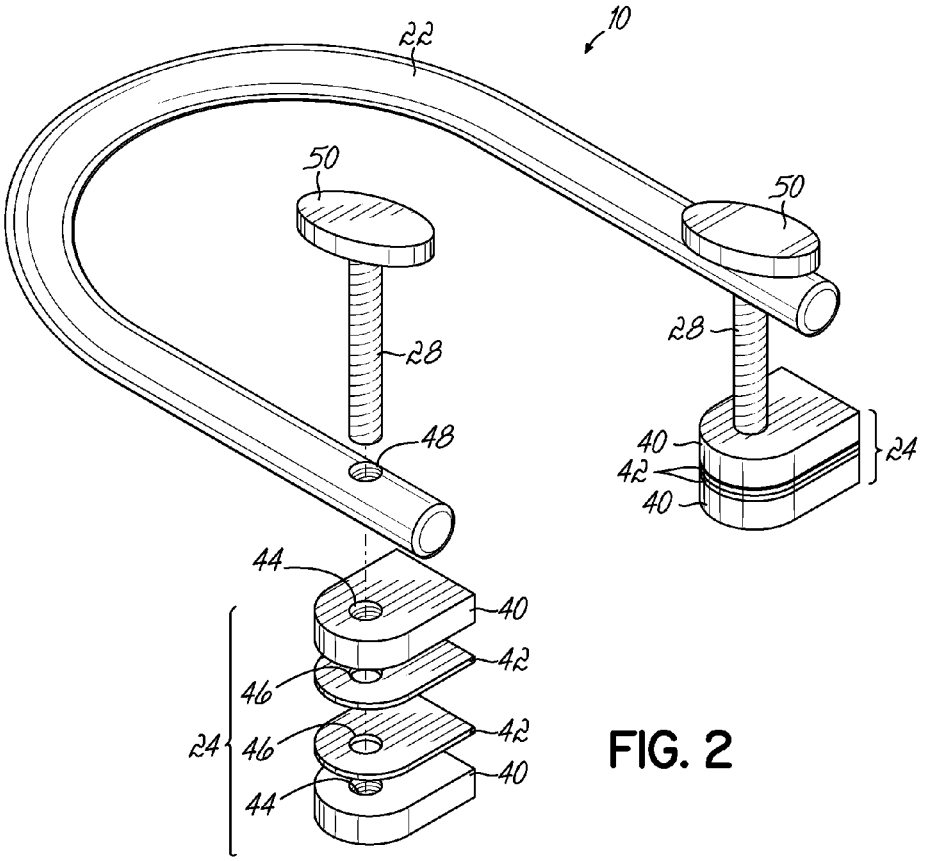
FIG. 2 is a partially exploded perspective view of the hand rest of FIG. 1.

FIG. 2 provides a side view of the hand rest 10 of FIG. 1. As shown, each securing member 24 may comprise two clamping plates 40 and two traction pads 42, where the clamping plates 40 may be configured with threaded openings and the traction pads may be configured with corresponding openings passing therethrough such that a threaded member 28 may pass through the threaded openings 44, corresponding openings 46, and a threaded opening 48 configured in the supporting portion 22 to thereby connect the securing member 24 to the supporting portion 22. Each threaded member 28 may comprise a flattened head 50 or other such configuration such that a user may rotate the threaded element by gripping the flattened head 50 and thereby adjust the clamping force of the securing member 24 and/or adjust the distance between the supporting portion 22 and the strings 18.

Figure 3:
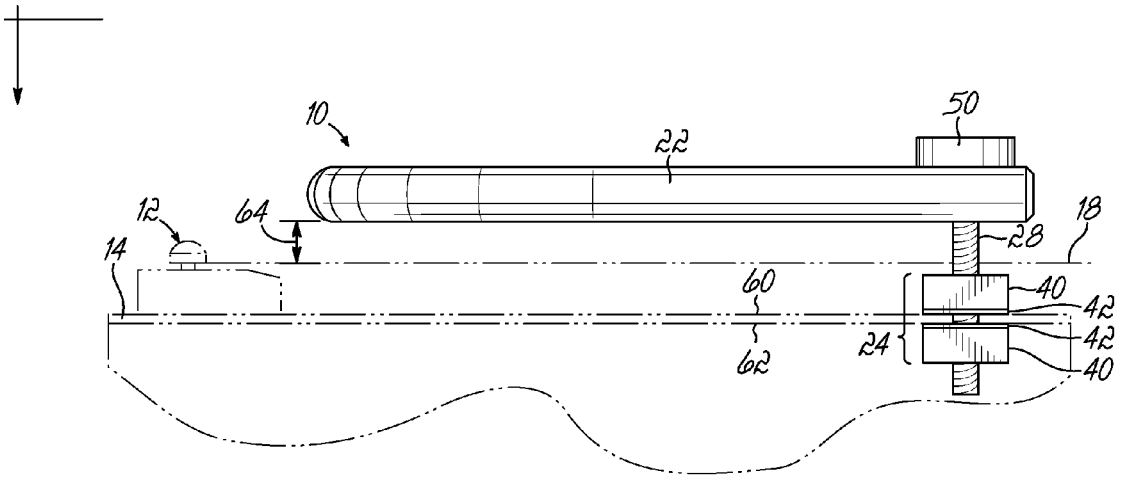
FIG. 3 is a side view of the hand rest of FIG. 1 removably coupled to a stringed instrument.

FIG. 3 provides a side view of the hand rest 10 of FIG. 1 removably coupled to the body 14 of the acoustic guitar 12. As shown, one or more securing members 24 of the hand rest 10 may be coupled to the body of the guitar 14 by clamping a top surface 60 and bottom surface 62 of the body of the guitar 12 proximate the sound hole 26 (not shown in FIG. 3) of the guitar 12. In this example figure, the securing member 24 comprises a clamp comprising clamping plates 44 and traction pads 46 disposed therebetween that grip the top 60 and bottom surface 62 of the body 14 of the guitar proximate the sound hole 26 (not shown). The clamping plates 44 may be adjusted to grip the top 60 and bottom surfaces 62 by rotating the threaded element 28. In addition the distance 64 between the supporting portion 22 and the strings 18 may be adjusted by rotation of the threaded element 28 and the position of the clamping plates 44 on the threaded member 28.

Traction pads 46 may be formed from a compressible, non-skid, and non-marring material such that the traction pads minimize movement of the hand rest during normal use and minimize damaging the finished surface of the guitar. The traction pads may be formed, for example, of rubber or foam, and may be separate from clamping plates 44 or integrated into clamping plates 44, e.g., through the use of an adhesive. The other components in hand rest 10 may be formed of various rigid materials, such as brass, stainless steel, other metals, or various plastics or composite materials.

In addition, it will be appreciated that other fasteners and fastening arrangements may be used to mount hand rest 10 to guitar 12. For example, threaded member 28 may not include flattened head 50, and a nut may be used to secure supporting portion 22 to threaded member 28. One or more of supporting member 22 and clamping plates 44 may lack threaded openings and slidably receive threaded member 28, with integrated or separate spacers or sleeves used to maintain appropriate separation between components. An additional nut may be disposed at the end of threaded member 28 opposite supporting portion 22 to impart the clamping force to clamping plates 44. In addition, in some embodiments, fastening arrangements other that threaded fastening arrangements may be used. For example, spring loaded clips may be used to clamp a hand rest to guitar 12, or screws could be used to permanently affix a hand rest to a guitar. Other variations for temporarily or permanently securing hand rest 10 to guitar 12 will be appreciated by one of ordinary skill in the art having the benefit of the instant disclosure.

Figure 4:
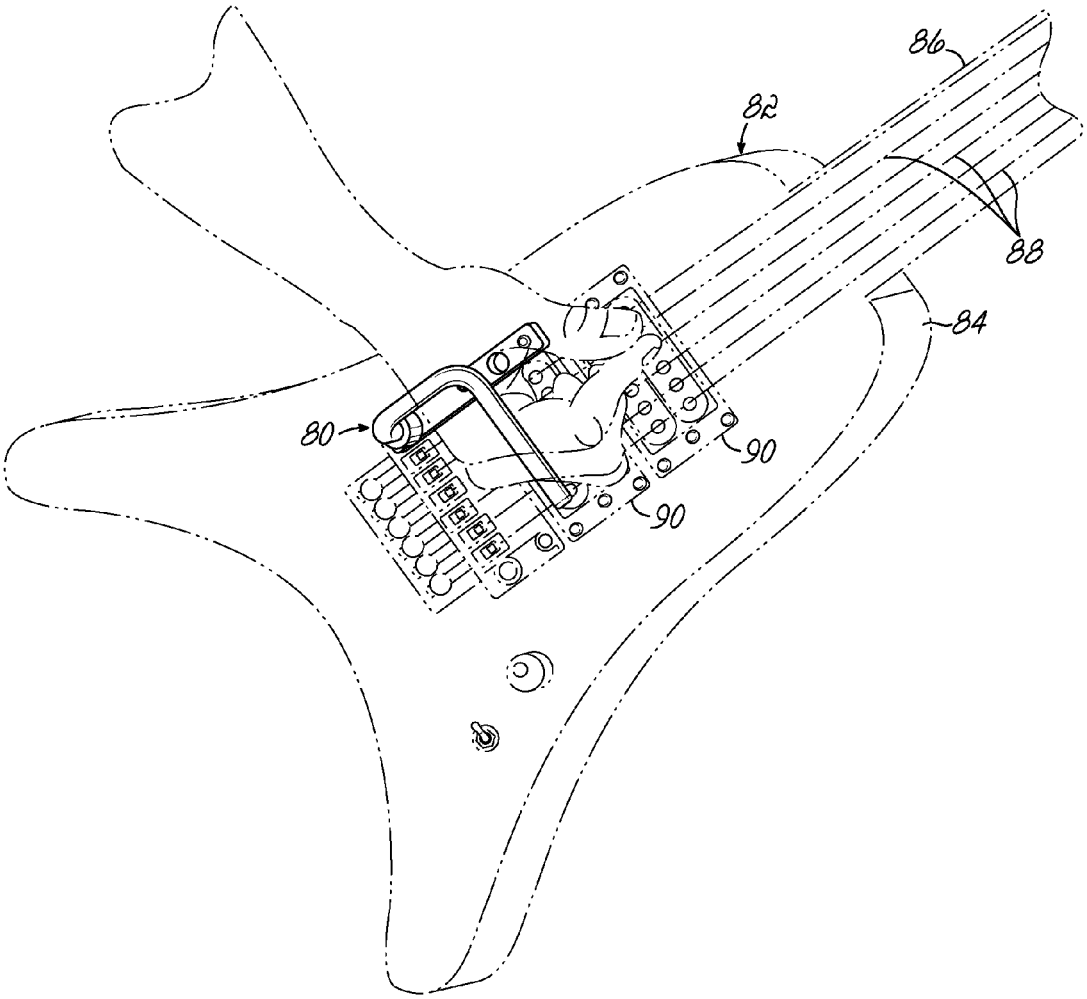
FIG. 4 is a diagram of a hand rest consistent with another embodiment of the invention and removably coupled to a stringed instrument.

Turning now to FIG. 4, this figure illustrates a hand rest 80 consistent with some embodiments of the invention. In this example, the hand rest 80 is removably coupled to an electric guitar 82 comprising a body 84, a neck 86, and a plurality of strings 86 coupled to the body 84 and extending up the neck 86 as shown in FIG. 4. As shown, the hand rest 80 may be coupled to the body 84 of the electric guitar 82 and positioned over the strings 88 at a location on the body 84 where the strings are to be struck by a user. In general, electric guitars comprise pickups, and in this example, the electric guitar comprises humbucker style pickups 90. In this particular embodiment, the hand rest 80 is configured to removably couple to the electric guitar by coupling to a humbucker pickup 90. While the provided example includes a humbucker style pickup, embodiments of the invention may be configured to removably couple to other styles of electric guitar pickups including single-coil pickups and/or various dimensional variations of the basic single coil/humbucker type pickups.

Figure 5:
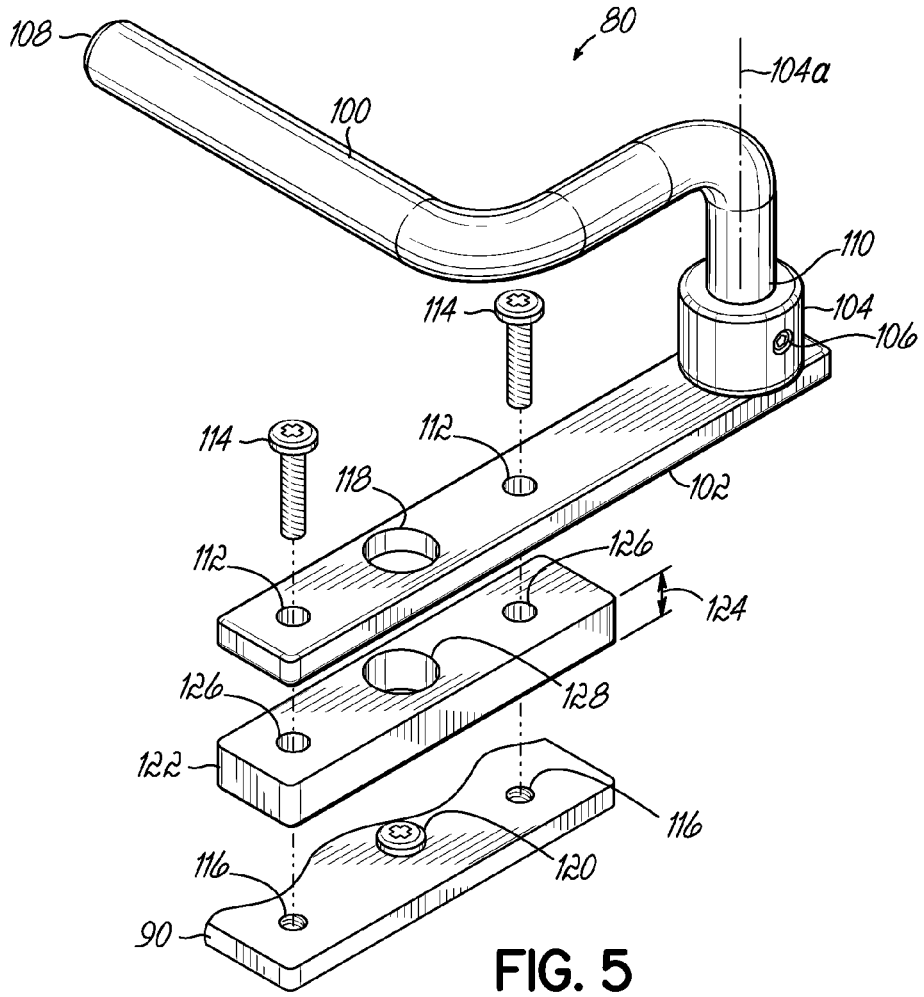
FIG. 5 is an exploded perspective view of an embodiment of the hand rest of FIG. 4.

FIG. 5 provides a perspective view of the hand rest 80 of FIG. 4. As shown, the hand rest 80 comprises a supporting portion 100 that includes a first end 108 that extends transversely to the strings when in an operational position and a second end 110 that extends perpendicularly to the first end and defines an axis of rotation 104*a* extending generally orthogonal to the top surface of the guitar as well as the plane of the strings. A sleeve 104 is slidably received by second end 110 and is used to control a height of the first end 108 relative to the strings, e.g., through the use of a set screw 106 or other fastener that secures the sleeve in a fixed position on the supporting portion.

In some embodiments, the supporting portion overlays the strings at a position between the bridge and the nut of the guitar, and in some embodiments, overlays the strings at a position over a pickup of a guitar, or between adjacent pickups of a guitar. By doing so, positioning of a user's hand or palm on the supporting portion does not restrict vibration of the strings.

The mounting plate 102 may be configured with one or more fastener openings 112 such that a fastener 114 (e.g., a screw, bolt, or other such known fastener) may pass therethrough and secure the mounting plate to the body of the guitar. Consistent with embodiments of the invention, fastener openings 112 may correspond to positions on a pickup of the guitar configured with threaded openings 116 to which a fastener 114 may be inserted. In this example, the fastener openings 112 of the mounting plate 102 are configured at positions on the mounting plate 102 to correspond to positions on a humbucker style pickup 90 configured with threaded openings 116. Furthermore, the mounting plate 102 may be configured with an adjustment screw opening 118 such that an adjustment screw 120 of the pickup 90 is accessible when the hand rest 80 is removably coupled to the electric guitar.

As shown in FIG. 5, the hand rest 80 may optionally include a shim 122 that may be placed between the mounting plate 102 and the body 84 (not shown) of the guitar when the hand rest 80 is removably coupled to the guitar. In general, the shim 122 may be of varying dimensions and the thickness 124 of the shim 122 generally corresponds to the distance between the supporting portion 100 and the strings 88. Hence, based on the type of instrument, user preference, and configuration of a hand rest consistent with embodiments of the invention, the hand rest may comprise a shim to thereby position the supporting portion of the hand rest a preferred distance from the strings. The example shim 122 of FIG. 5 is configured with fastener openings 126 that correspond to the fastener openings 112 of the mounting plate 102 and an adjustment screw opening 128 that corresponds to the adjustment screw opening 118 of the mounting plate 102.

Figure 6:
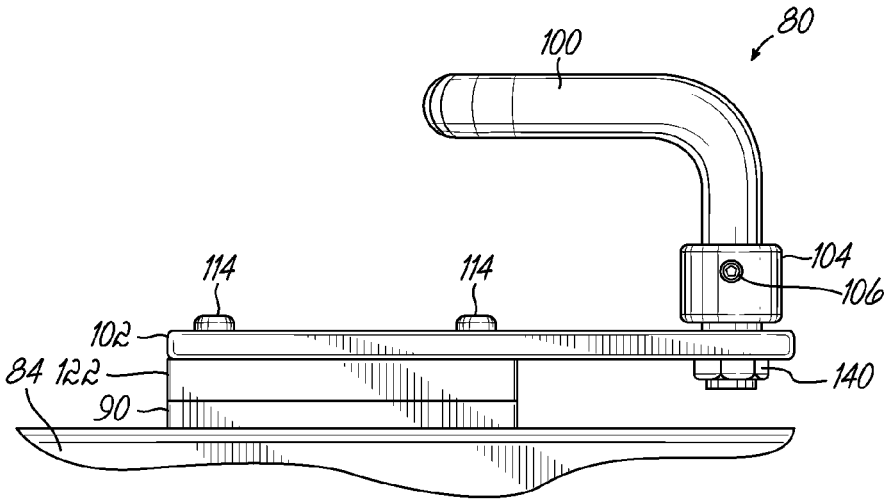
FIG. 6 is a side view of the hand rest of FIG. 4.

FIG. 6 provides a side view of the hand rest 80 of FIG. 4 removably coupled to the body 84 of the guitar. As shown, the supporting portion 100 may be connected to sleeve 104 by a fastener 106. A fastener 140, e.g., a nut, engages threads on second end 110 of supporting portion 100 to secure supporting portion 100 to mounting plate 102 in a pivoting arrangement. In some embodiments, fastener 140 may be used to control how freely supporting portion 100 is allowed to pivot relative to mounting plate 102, as in many embodiments it is desirable for supporting portion 100 to remain in a relatively stable angular position when in use. In some embodiments, fastener 140 may be secured (e.g., welded or adhered) to mounting plate 102, or in some embodiments may be integral with mounting plate 102, such that rotation of supporting portion 100 relative to mounting plate 102 threads second end 110 of supporting portion 100 further into fastener 140 and increases the friction between mounting plate 102 and sleeve 104, thereby tightening the supporting portion in an operative position over the strings. In addition, in this latter configuration, supporting portion 100 may be removed from mounting plate 102 through rotation of supporting portion 100 in an opposite direction (e.g., counterclockwise). As such, a user is able to leave the mounting plate secured on the guitar and easily install or remove the supporting portion based on whether the user wishes to utilize a hand rest when playing the guitar.

In other embodiments, other fastening arrangements, such as one or more detents located at predetermined angular positions, springs, or other tensioning arrangements, may be used to restrict free rotation of the supporting portion during operational use.

As shown in this embodiment, the mounting plate 102 is positioned on the shim 122, and the shim 122 is positioned on a portion of the pickup 90 coupled to the body 84. Fasteners 114 removably couple the mounting plate 102 and the shim 122 to the portion of the pickup 90.

Figure 7:
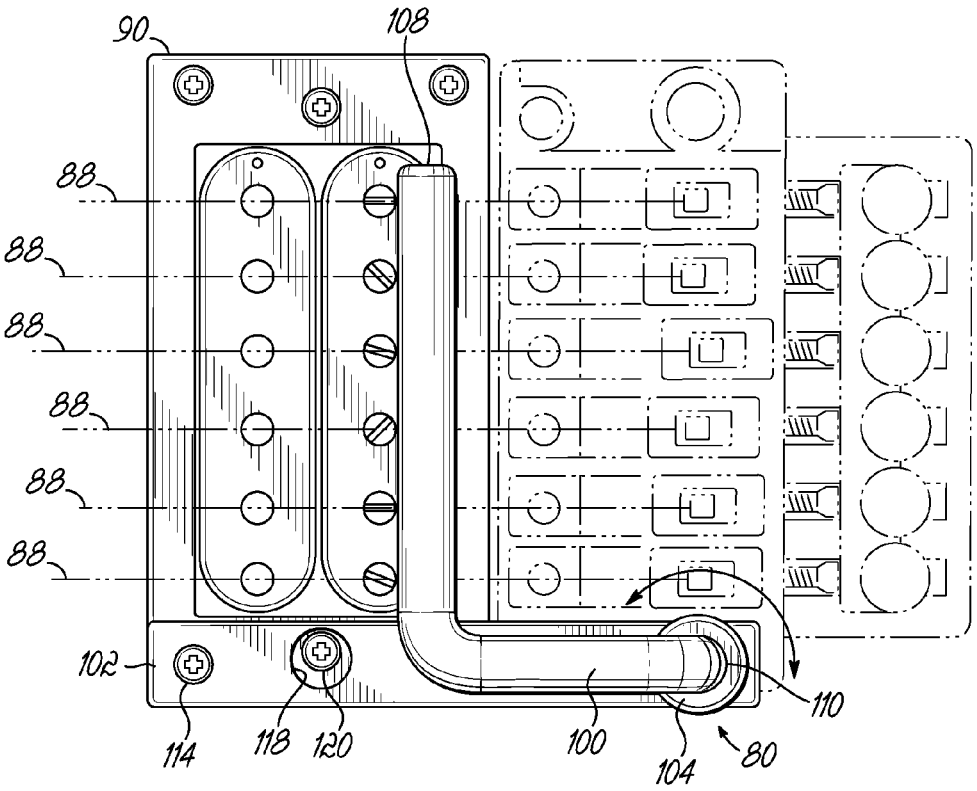
FIG. 7 is a top view of an embodiment of the hand rest of FIG. 4 removably coupled to a stringed instrument and rotated to a first position such that a portion of the hand rest is positioned over the strings of the stringed instrument.
Figure 8:
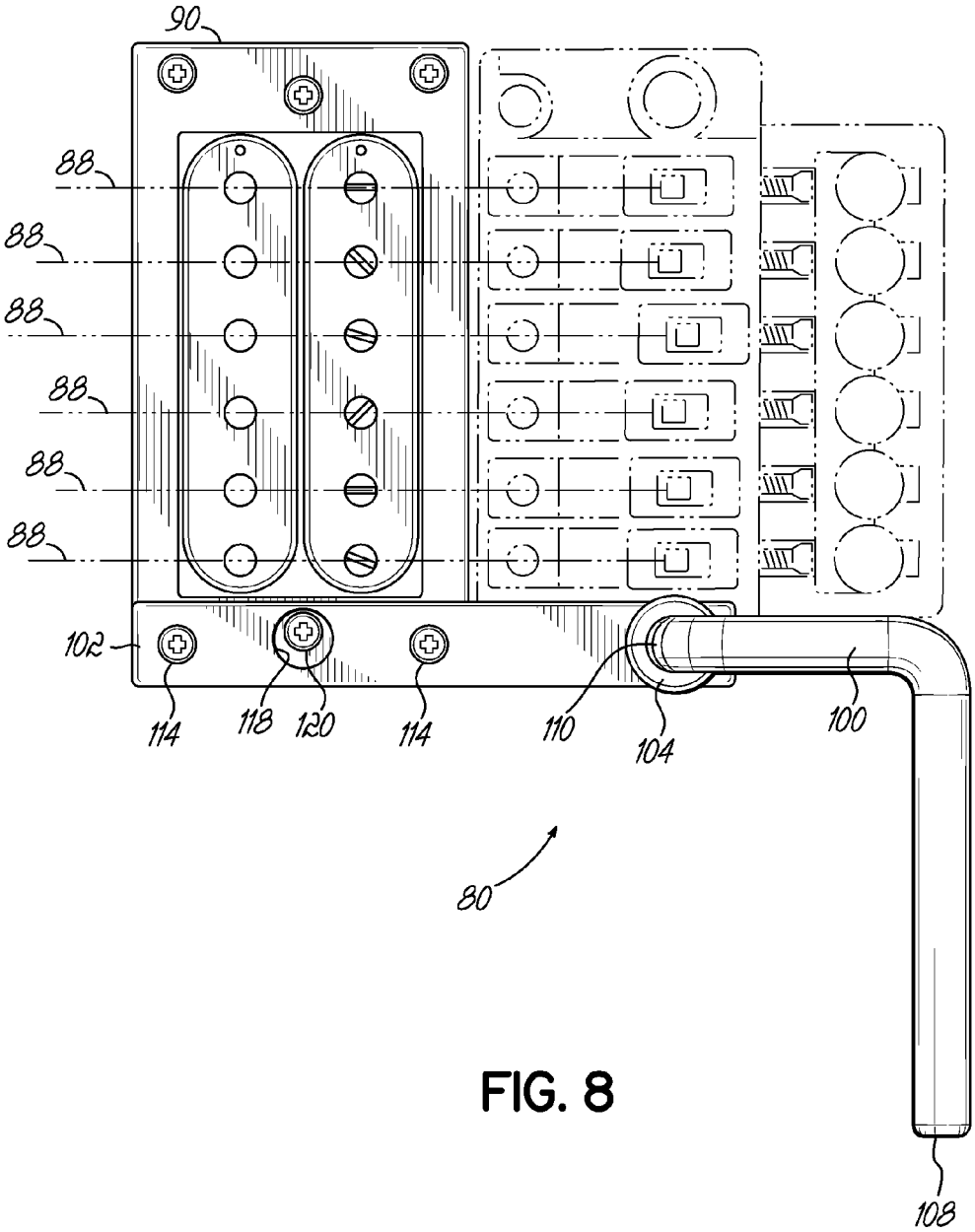
FIG. 8 is a top view of an embodiment of the hand rest of FIG. 4 removably coupled to a stringed instrument and rotated to a second position such that a portion of the hand rest is not positioned over the strings of the stringed instrument.

FIGS. 7 and 8 provide a top view of the hand rest 80 of FIG. 4 when removably coupled to the electric guitar. In particular, FIG. 7 illustrates an example of the hand rest 80 of FIG. 4 when the supporting portion 100 is rotated to a first position, such that the supporting portion 100 is positioned over the strings 88 of the electric guitar. As shown in this example, the first end 108 of the supporting portion 100 is rotated relative to the second end 110 such that at least a portion of the supporting portion 100 is positioned over the strings 88 and approximately perpendicular to the strings 88 such that a user may rest a hand on the supporting portion 100 and strike (i.e., pick, pluck, actuate) one or more strings 88. As discussed, the supporting portion 100 is positioned over the strings such that the supporting portion 100 does not interfere with vibration of the strings 88 upon actuation by a user. As discussed previously, the mounting plate 102 is removably coupled to the body 84 of the guitar by fasteners 114 that pass through the fastener openings 112 of the mounting plate 102 and optionally the shim 122 and screw into threaded openings configured on the body of the guitar. In this example, such threaded openings 116 are configured on a pickup 90 of the guitar. Moreover, as shown, an adjustment screw 120 of the pickup 90 is accessible through an adjustment screw opening configured on the mounting plate 102 and optionally the shim 122.

FIG. 8 illustrates an example of the hand rest 80 of FIG. 4 when the supporting portion 100 is rotated to a second position, such that the supporting portion 100 is not positioned over the strings 88. As shown in this example, the first end 108 of the supporting portion 100 is rotated relative to the second end 110 such that the supporting portion is not positioned over the strings 88. Therefore, as illustrated by FIGS. 7 and 8, the pivoting relationship between mounting plate 102 and second end 110 of supporting portion 100 allows a user to rotate the supporting portion 100 to a first position (i.e., FIG. 7) over the strings 88 when the user desires to rest a hand on the supporting portion 100. When the user does not want to make use of the hand rest 80, the user may rotate the supporting portion to a second position (i.e., FIG. 8) such that the supporting portion 100 is not positioned over the strings. In some embodiments, it may be desirable for the second position to position the supporting portion in an area that does not interfere with the user's hand when playing the guitar. Furthermore, in some embodiments, the supporting portion may be secured to a pickup on the opposite side from that shown in the figures, e.g., for a guitar, proximate the highest pitch string instead of the lowest pitch string as shown in the figures.

In still other embodiments, a hand rest need not be coupled to a pickup or pickup housing, and may be directly secured to the body of the guitar, or secured to another component of the guitar such as a plate or bridge. Alternative fastening arrangements beyond those illustrated herein will be appreciated by one of ordinary skill in the art having the benefit of the instant disclosure.

Consistent with embodiments of the invention, a hand rest may be removably or permanently coupleable with a stringed instruction and configured such that at least a portion of the hand rest is positioned over the strings of the stringed instrument such that a user may rest a hand on the hand rest while striking the strings. Importantly, the at least a portion of the hand rest positioned over the strings is spaced apart from the strings such that the hand rest does not interfere with vibration of the strings. In particular embodiments a hand rest consistent with the invention may utilized by a user on a guitar, such that the user may rest a hand over the strings of the guitar without interfering with the vibration of the strings. Furthermore, particular embodiments may utilize various materials and finishes to match a particular stringed instrument, and/or to prevent rusting from extended contact with a hand. For example, the hand rest may include powder coated metal components. In addition, a hand rest consistent with embodiments may be at least partially constructed with aluminum or steel which may provide advantages with respect to durability. Moreover, as discussed previously, dimensions of hand rests consistent with embodiments of the invention may be configured to accommodate a particular stringed instrument. For example, a hand rest for an electric guitar may be different dimensions that a hand rest for an acoustic guitar, a bass guitar, a banjo, a mandolin or other stringed instrument. Moreover, at least a portion of a hand rest consistent with embodiments may be removably coupleable from a stringed instrument, or alternatively may be permanently fixed to a stringed instrument. In addition, as illustrated by the examples provided in the drawings, portions of hand rests consistent with embodiments of the invention configured to couple to the stringed instrument may vary based on the type of instrument and/or user preference.

Further in some embodiments, a hand rest may have a supporting portion that is moveable between one or more positions that overlay the strings of a stringed instrument and one or more positions that do not overlay the strings and do not otherwise interfere with the user's hand. For example, it may be desirable in some embodiments to provide a position of the supporting portion that enables a user to use a palm muting and/or strumming technique when playing a stringed instrument. In other embodiments, however, the supporting potion may not be moveable.

Various additional advantages and modifications beyond those discussed herein will be apparent to one of ordinary skill in the art. For example, additional variations are discussed and illustrated in the aforementioned provisional application that is incorporated by reference herein. Therefore, the invention lies in the claims hereinafter appended.

What is claimed:

1. A hand rest for a stringed instrument comprising:

a supporting portion positioned over strings of the stringed instrument to support a user's hand during use of the stringed instrument such that a portion of the user's hand may be suspended over the strings without inhibiting vibration of the strings, wherein the supporting portion is pivotable between a first position overlaying the strings of the stringed instrument and a second position not overlaying the strings of the stringed instrument; and a securing member coupling the supporting portion to the stringed instrument.

2. The hand rest of claim 1, wherein the supporting portion is pivotable about an axis of rotation that is generally orthogonal to a top surface of the stringed instrument.

3. The hand rest of claim 2, wherein the supporting portion includes a first end that is configured to overlay the strings of the stringed instrument when the supporting portion is rotated to the first position and not overlay the strings of the stringed instrument when the supporting portion is rotated to the second position.

4. The hand rest of claim 1, wherein the securing member is configured to removably couple the supporting portion to the stringed instrument.

5. The hand rest of claim 1, wherein the supporting portion is configured to support a user's palm in a suspended position over the strings without inhibiting vibration of the strings.

6. A hand rest for an electric guitar comprising:

a mounting plate configured to removably couple to a portion of an electric guitar; and a supporting portion connected to the mounting plate and configured to be positioned over strings of the electric guitar when the mounting plate is removably coupled to the electric guitar to support a user's hand during use of the electric guitar such that a portion of the user's hand may be suspended over the strings without inhibiting vibration of the strings, wherein the supporting portion is pivotable between a first position overlaying the strings of the electric guitar and a second position not overlaying the strings of the electric guitar.

7. The hand rest of claim 6, wherein the supporting portion comprises a first end and a second end, the second end configured to extend along an axis of rotation that is generally orthogonal to a top surface of the electric guitar, wherein the second end is pivotably coupled to the mounting plate to enable the first end of the supporting portion to rotate between the first position overlaying the strings of the electric guitar and the second position not overlaying the strings of the electric guitar.

8. The hand rest of claim 6, wherein the mounting plate is configured to removably couple to a humbucker style guitar pickup.

9. The hand rest of claim 8, wherein the mounting plate is configured with an opening passing therethrough positioned such that when the mounting plate is removably coupled to the humbucker style pickup, an adjustment screw of the humbucker style pickup is accessible through the opening.

10. The hand rest of claim 6, further comprising:

a shim positioned between the mounting plate and the portion of the electric guitar when the mounting plate is removably coupled to the electric guitar.

11. A hand rest for an acoustic guitar comprising:

a supporting portion comprising first and second opposing ends and positioned over the strings of the acoustic guitar to support a user's hand during use of the acoustic guitar such that a portion of the user's hand may be suspended over the strings without inhibiting vibration of the strings; and at least one securing member configured to removably couple at least one of the first and second opposing ends of the supporting portion to a sound hole of the acoustic guitar.

12. The hand rest of claim 11, wherein the securing member includes a clamping arrangement that is configured to removably couple to a top surface and a bottom surface of a body portion of an acoustic guitar proximate the sound hole.

13. The hand rest of claim 12, wherein the clamping arrangement comprises a traction pad, and the clamping arrangement is configured to adjustably clamp the top surface and bottom surface with the traction pad engaging at least one of the top and bottom surfaces.

14. The hand rest of claim 12, wherein the clamping arrangement comprises a rotatable member configured to adjust a clamping force of the clamping arrangement on the top and bottom surfaces.

15. The hand rest of claim 11, wherein the securing member is a first securing member connected to the first end of the supporting portion, the hand rest further comprising:

a second securing member connected to the second end of the supporting portion and configured to removably couple the second end of the supporting portion to the acoustic guitar.

16. The hand rest of claim 11, wherein the supporting portion includes a generally u-shaped portion positioned over the strings.

* * * * *